US006988755B2

(12) United States Patent
Lukas

(10) Patent No.: US 6,988,755 B2
(45) Date of Patent: Jan. 24, 2006

(54) GUN GURNEY

(75) Inventor: Jay J. Lukas, 24309 Cambridge, Woodhaven, MI (US) 48183

(73) Assignee: Jay J. Lukas, Woodhaven, MI (US)

( * ) Notice: Subject to any disclaimer, the term of this patent is extended or adjusted under 35 U.S.C. 154(b) by 425 days.

(21) Appl. No.: 10/315,443

(22) Filed: Dec. 10, 2002

(65) Prior Publication Data

US 2004/0108235 A1 Jun. 10, 2004

(51) Int. Cl.
*A45F 5/00* (2006.01)

(52) U.S. Cl. ..... 294/1.1; 294/82.11; 224/913

(58) Field of Classification Search ..... 294/1.1, 294/82.11, 150, 151, 165; 224/149, 150, 224/581, 913, 916; 5/628
See application file for complete search history.

(56) References Cited

U.S. PATENT DOCUMENTS

| | | | | |
|---|---|---|---|---|
| 3,167,182 A | | 1/1965 | Calvin | |
| 3,261,521 A | | 7/1966 | Meccico et al. | |
| 3,294,247 A | | 12/1966 | Norrington | |
| 3,910,382 A | | 10/1975 | Justice | |
| 4,120,436 A | | 10/1978 | Burch | |
| 4,760,944 A | * | 8/1988 | Hughes | 224/609 |
| D311,813 S | | 11/1990 | Oliver | |
| 5,116,010 A | | 5/1992 | McMasters et al. | |
| 5,263,675 A | | 11/1993 | Roberts et al. | |
| 5,388,877 A | * | 2/1995 | Wenk | 294/1.1 |
| 5,655,803 A | | 8/1997 | Tacoronte | |
| 5,685,103 A | | 11/1997 | Wiggins | |
| 6,019,404 A | | 2/2000 | Pasquale | |
| D446,839 S | | 8/2001 | Cantrell | |

* cited by examiner

*Primary Examiner*—Dean J. Kramer

(57) ABSTRACT

The gurney is for lifting firearms, such as shotguns, rifles, archery bows and hunting equipment to an elevated hunting position. The gurney includes a molded urethane fixture or base member with slots longitudinally aligned along the longitudinal edges thereof. A lifting catch is provided on the rear surface of the fixture near the upper end portion thereof. The catch is centrally located. A pair of Velcro straps are provided which extend through pairs of laterally aligned slots that best fit each firearm. The Velcro straps are wrapped around the firearm and secured. A lifting cord with a snap hook on one end is attached to the lifting catch. The other end of the cord is attached to a tree limb or elevated platform or tree stand in a clear area and secured at a predetermined height that will prevents the firearm, archery bow or equipment from hitting the ground. Once the hook is attached to the catch on the fixture, the firearm, archery bow or equipment is ready to be safely hoisted.

12 Claims, 2 Drawing Sheets

GUN GURNEY

BACKGROUND OF THE INVENTION

1. Field of the Invention

The present invention relates to hunting equipment and accessories. More particularly, the present invention relates to a gun gurney or safety device for transporting firearms, rifles, shot guns, archery bows and equipment from ground level to an elevated hunting position.

2. Brief Description of the Prior Art

Throughout the realm of hunting activities, sportsmen and sportswomen have commonly encountered difficulty in transporting their firearms such as rifles or shot guns, from the ground to a hunting stand or an elevated position. Techniques used in the prior art include many unsafe and cumbersome procedures. For example, some hunters tie a rope to their firearm, climbing to their respective hunting stand or elevated position with the rope in hand, and thereafter lifting the firearm or archery bow or other hunting equipment with the rope, running the risk that an expensive firearm may be damaged and/or the firearm may accidentally discharge while being juggled about during this lifting operation. In addition other hunters attempt to climb to the hunting stand with a firearm thrown over the shoulder, consequently subjecting the hunter to the risk of damaging the firearm while climbing, dropping the firearm or perhaps more seriously, having the firearm inadvertently discharge or subjecting the hunter to potential injury should he or she fall upon the firearm while climbing to the hunting stand.

Many states now allow hunting from elevated positions, that is above ground level such as through the use of tree stands or elevated platforms. When a hunter engages in this sport it is necessary for the hunter to safely and easily move himself or herself, firearms, archery bows and equipment to and from the elevated position. Several prior devices are known which allows a hunter to climb while carrying their equipment by way of slings, backpacks or simply holding equipment in their hands. All of these methods are dangerous and cumbersome. It is recognized that a safer approach to hoisting firearms and hunting equipment to an elevated position is to leave all equipment on the ground and attach the equipment to a rope or cord. The hunter can then hoist the equipment from the elevated platform or tree stand. This would allow the hunter to have both hands free for climbing to and from the elevated position. Simply attaching a rope or cord to a firearm often resulted in damage to the equipment and in addition put the hunter's safety at risk. In other occasions firearms have been tied off through the trigger housing allowing the gun to flip over and discharge. Hunters most often go to and from their hunting spots in the dark or in near dark conditions. Darkness and cold weather interfere with the hunter's ability to properly tie a firearm or archery bow for safe lifting from the ground to an elevated position.

U.S. Pat. No. 3,910,382 entitled "RIFLE LIFT" issued to Jerry Patent Justice on Oct. 7, 1975. It discloses a safety rifle lift for transporting a rifle between the ground and a hunting stand while releasably holding the rifle in an upright and safe position.

U.S. Pat. No. 5,655,803 entitled "UNIVERSAL FIREARM BOW AND PACK HOIST-LINE" issued on Oct. 12, 1997 to Henry Michael Tacoronte. It discloses a hoisting device for supporting an elongate firearm or archery bow. The hoist line has a snap hook for attachment to a rifle trigger guard and a fixed barrel engagement loop, each permanently attached to an elongated hoist line near its bottom end. The trigger guard snap hook and barrel engagement loop are sized and spaced apart to maintain an attached rifle in a vertical orientation when a device is hoisted from above. Modifications to the hoist line includes a bow engaging strap and string engaging strap for the temporary attachment of an archery bow adjacent to an attached firearm.

Other devices, similar in nature, are known including U.S. Pat. No. 6,019,404 entitled "HOISTING HARNESS FOR A FIREARM" which issued on Feb. 1, 2000 to Michael Pasquale and U.S. Design Pat. No. 446,839 entitled "SLEEVE ENCLOSURE FOR LIFTING A HUNTING FIREARM OR BOW" which issued on Aug. 21, 2001 to Raymond Cantrell. The problems with the prior art lift devices as disclosed in the aforementioned patents are that the devices are most often large, cumbersome and difficult to use as well as to maintain.

SUMMARY OF THE PRESENT INVENTION

Accordingly, it is a primary feature of the present invention to provide a hoisting device or gun gurney which is attachable to elongated firearms, shot guns and rifles, archery bows and other hunting equipment with which hunters, having first climbed to an elevated location above the ground may safely hoist the firearm.

It is another feature of the present invention to provide a hoisting device or gun gurney for firearms, archery bows and hunting equipment, with the device to be used by hunters who hunt from elevated positions, such as elevated platforms and tree stands.

Still another feature of the present invention is to provide a hoisting or lifting device that provides safety and protection to both the hunter and his or her equipment.

A further feature of the present invention is to provide a gun gurney or lifting device that is both quickly and easily attached and removed to firearms, guns and rifles, archery bows and other related equipment through the use of Velcro straps which eliminates the requirement for tying knots or working with buckles.

A still further feature of the present invention is to provide a lifting device or gun gurney that will fit nearly all sizes and models of rifles or shot guns.

Another feature of the present invention is to provide a lifting device or gun gurney that will not scratch or damage the equipment being hoisted through the use of a base or fixture that is flat, smooth, flexible and is made from urethane by an injection molding process.

Still another feature of the present invention is to provide a lifting device or gun gurney that is small and light weight, with the device being easily transported and can be left attached to firearms or archery bows and of a size to fit within the respective carrying cases of the firearms or archery bows.

A further feature of the present invention is to provide a lifting device or gun gurney that is strong enough to lift most any firearms designed for sports hunting, with the fixture or base member being made of urethane that is strong, flexible and weather resistant.

A still further feature of the present invention is to provide a lifting device that can hoist a firearm with the barrel pointing either upwardly or downwardly.

Another feature of the present invention is to provide a lifting device or a gun gurney that can be quickly disconnected at the end of a day's hunting by simply removing the hook provided on the lifting rope from the catch provided on the base member of the gun gurney. With such a construction the cord and hook will be in position for use the following day or days, with the fixture or base member remaining attached to the firearm or bow.

Still another feature of the present invention is to provide a lifting device that will provide a straight vertical lift for the firearm or archery bow thereby avoiding spinning and flipping of the firearm or archery bow that will cause the equipment to be damaged or dropped.

A further feature of the present invention is to provide a lifting device that is designed primarily for hoisting firearms and archery bows yet can be quickly converted into a conventional means of lifting other equipment.

A still further feature of the present invention is to provide a lifting device that is safe, strong, small and easy to use.

Still another feature of the present invention is to provide a lifting device which is rugged and durable, and is also relatively inexpensive, easy to manufacture and to use in the field.

With the above and other features in view, my invention resides in the novel features of form, construction, arrangement and combination of parts presently described and pointed out in the claims of this invention.

The invention possesses many other advantages and has other purposes which may be made more clearly apparent from a consideration of the forms in which it may be embodied. One of these forms is hereinafter described in the detailed description of this invention. However, it is to be understood that this detailed description is only illustrative of the principles of the invention and is not to be taken in a limiting sense.

DETAILED DESCRIPTION OF THE PREFERRED EMBODIMENT OF THE INVENTION

Figure 3:
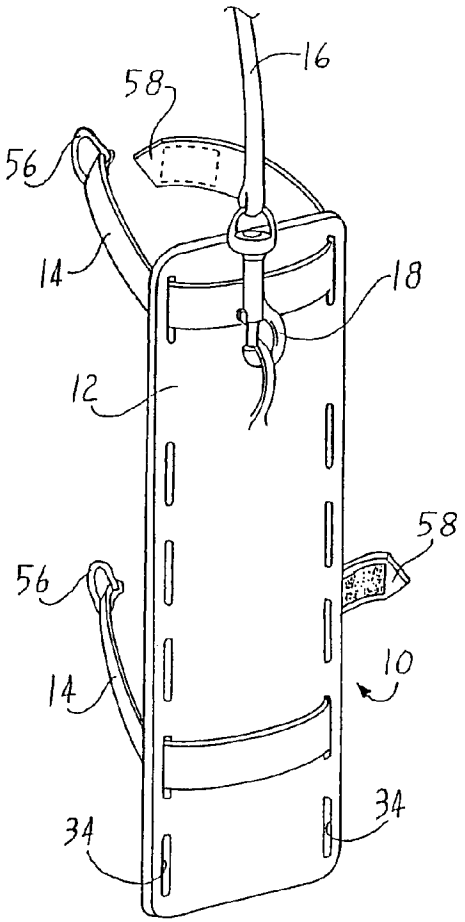
FIG. 3 is a perspective view of the gurney lifting device showing the base member with the Velcro straps spaced apart and the cord and snap hook assembly attached to the catch of the base member.

Referring now to the drawings, the gurney 10 of the present invention comprises an elongated unitary base member or hoisting fixture 12, pair of Velcro straps 14 and a lifting cord 16 having on one end a snap hook 18 as shown in FIG. 3.

The elongated unitary base member or hoisting fixture 12 has an elongated longitudinally extending center axis 20, a generally flat surface 22 and a parallel rear surface 24. The surfaces 22 and 24 form spaced opposite substantially planar areas.

Spaced inwardly from each of the spaced planar longitudinal edges 26 and 28 are rows 30 and 32 of longitudinally spaced slots 34. The slots 34 in one row 30 are laterally spaced from corresponding slots in the row 32. The slots 32 and a catch 36 on the rear surface 24 are formed in the unitary base member or hoisting fixture 12 during the manufacture thereof utilizing a urethane molding process. The material selected is urethane-95 or equivalent material that will be of sufficient strength to support the firearms, shotguns, rifles or other equipment that may be typically hoisted to an elevated position for the purpose of hunting. The hoisting fixture or base member 12 is adapted to safely hoist firearms, such as shotguns and rifles, archery bows and other equipment to an elevated platform 40 mounted in a tree 42 having a limb 44, with the lifting cord 16 suspended on limb 44 as will subsequently appear.

The catch 36 is of arcuate configuration and defines a space 38 with the opposite underlying portion of the rear surface 24. The catch 36 is located midway between the pair of parallel longitudinally extending edges 26 and 28 and the rows 30 and 32 of longitudinally spaced slots 34. The catch 36 is located near the first end portion of the base member 12 which forms the top of the base member 12. The other end portion 39 forms the bottom of the base member 12. The comers of the base member 12 are curved or rounded to eliminate sharp edges for safety purposes. The elongated slots 34, six in number in each row 30, 32 have the ends of each slot curved on a radius as shown in the drawings.

The pair of Velcro straps 14 are required for securing the firearm, shotgun or rifle 50 or archery bow 52 to the front surface 22 of the base member 12. The Velcro straps 14 are ¾" wide and 12" in length. Each Velcro strap 14 has a plastic loop 56 at one end and a tapered or curved surface 58 on the other end so as to facilitate the entry of end 58 through the loop 56. The lifting cord 16 is preferably constructed of a narrow band of non-elastic material. Such material is flexible and has the ability to withstand out-of-door conditions. The lifting cord 16 should be at least ⅛" in diameter and have the ability to carry the weight of the firearms or other equipment. The lifting cord 16 should be approximately 20 to 25 feet in length. In the preferred embodiment of the invention, the cord 16 will have a single snap hook 18 permanently attached to one end as shown in FIG. 3. Snap hook 18 is constructed of a weather resistant material such as plastic or stainless steel. The snap hook 18 must be able to withstand the same weight requirement as the cord 16.

It is well known that firearms should never be lifted with bullets or shells in the chambers. However, having the barrel pointing down is the safest position in the event of an accidental discharge of the weapon while hoisting the weapon to the tree stand. When hunting with an archery bow, the hoisting fixture or base member can be left attached to the archery bow while hunting, if desired, by simply removing the hook from the catch provided on the hoisting fixture 12.

Figure 1:
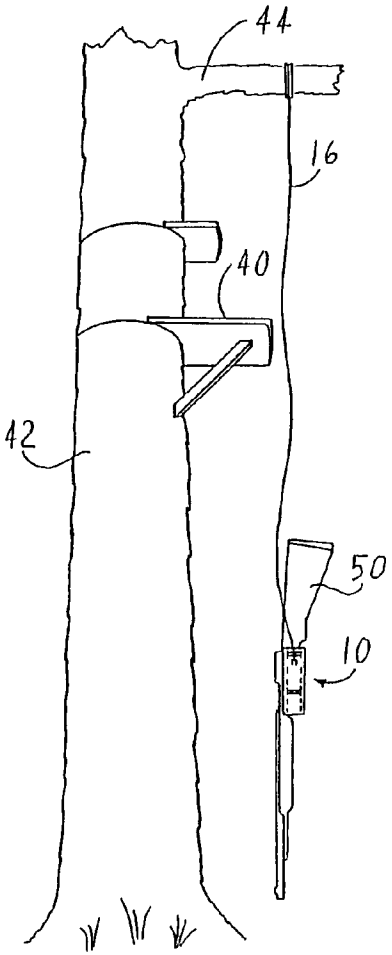
FIG. 1 is a perspective view of a tree and an elevated tree stand, with the lifting device of the present invention attached to a tree limb and with the gurney supporting the shot gun or rifle, with the butt end up and the barrel end down.

The method of using the present invention to hoist firearms, such as a rifle or shotgun 50, to an elevated position such as the tree stand 40 of FIG. 1 follows. After the elevated hunting platform or tree stand 40 has been erected, the cord 16 and hook 18 are to be tied off securely to the tree 42, tree stand or platform in an area that is clear of obstructions and will allow for firearms 50, archery bows 52 or equipment to be hoisted without interference so as to be less likely to become entangled in tree branches, ladders or foot pegs.

The cord 16 should be tied off in such a manner that it will not become loose or allow equipment to slip. The cord 16 should be tied in such a manner that the hook 18 will be easily accessible from the ground but now allow the firearm 50, archery bow 52 or equipment to hit the ground. The distance the hook 18 is positioned above the ground will depend on the size of the firearm 50, archery bow 52 or equipment being hoisted. In the case of firearms 50, such as shotguns and rifles, the distance between the hook and the ground will depend on which method of hoisting the hunter selects (barrel pointing upward or barrel pointing downward).

Figure 2B:
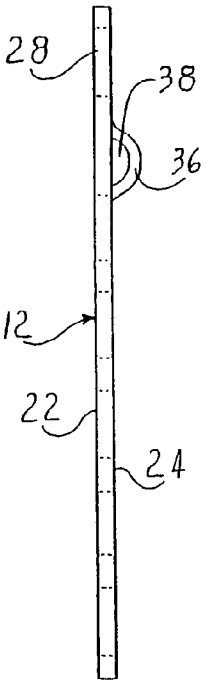
FIG. 2B is a side elevational view of the base member illustrated in FIG. 2A.
Figure 2A:
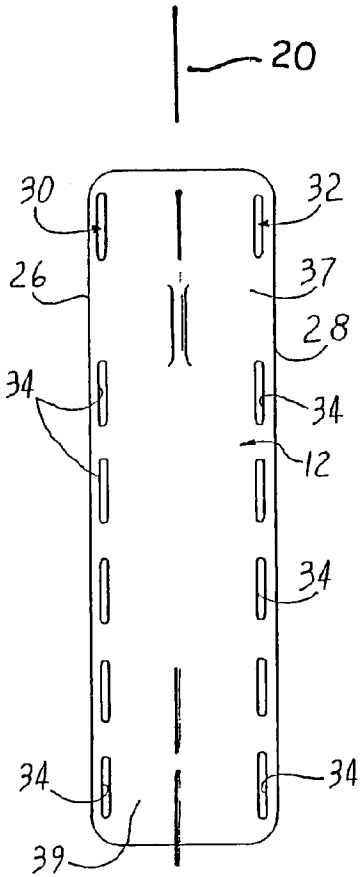
FIG. 2A is a rear view of the base member of the gurney showing the rows of longitudinally aligned slots and the catch at the top end of the base member.

In the preferred embodiment of the present invention, the integral catch 36 which is formed during the urethane molding process is centered vertically on the base member or hoisting fixture 12 and is offset horizontally in the upper end portion 37 as shown in FIG. 2A. In the present invention, the catch 36 is considered to be located at the top of the hoisting fixture 12.

Figure 4:
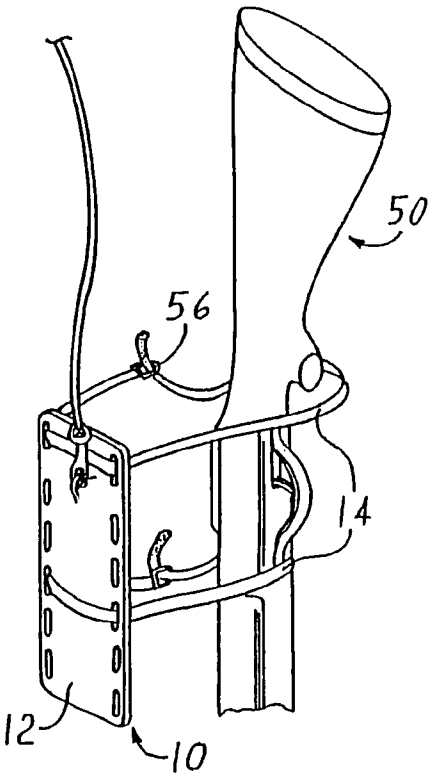
FIG. 4 is a fragmentary perspective view of the gurney lifting device showing the manner in which the Velcro straps attach to the butt end of the rifle exteriorly of the trigger housing.

When the method of hoisting (barrel pointing upward or barrel pointing downward), a firearm 50 has been determined, the base member or hoisting fixture 12 is then attached to the firearm 50. For hoisting a firearm 50 with the barrel pointing downward, as shown in FIGS. 1 and 4, this is accomplished by placing the smooth side or front surface 22 (without the catch 36) of the hoisting fixture 12 against the stock of the firearm 50. As such, the top or catch end 37 of the fixture 12 is pointing away from the barrel of the firearm 50. One of the Velcro straps 14 is extended through the top pair of slots 34 as shown in FIG. 4. Thereafter, the hunter finds the narrowest part of the firearm stock and wraps the Velcro strap 14 around the firearm 50 and through the loop 56 of the Velcro strap 14.

Using the second Velcro strap 14, the hunter selects a second pair of laterally aligned slots 34 that will allow the Velcro straps 14 to best secure the base member 12 to the firearm 50. Both Velcro straps 14 are tightened and the ends are secured. The straps 14 do not extend into the trigger housing but are located above and below the housing as shown in FIG. 4. The firearm is now ready to be moved to the hunting position and attached to the previously suspended cord 16 and hook 18 by snapping the hook 18 through the catch 36 as shown in FIG. 4.

The firearm 50 is now ready to be hoisted to the elevated hunting position as shown in FIG. 1. After the hunter has safely raised the firearm 50 to the elevated hunting position, the Velcro straps 14 are loosened and the firearm 50 removed from the base member or mounting fixture 12. When the hunter is ready to lower the firearm 50, he or she places a firearm back through the Velcro straps 14 and retightens the straps 14, reconnects the cord 16 and hook 18 to the catch 36 and slowly lowers the firearm 50 towards the ground. The hunter can now exit from the elevated position by having both hands free to maximize safety. Once on the ground, the hunter will disconnect the cord 16 and hook 18 from the catch 36. The base member 12 and Velcro straps 14 can remain attached to the firearm 50. When the hunter returns to the hunting site, he or she need only to reconnect the cord 16 and hook 18 to the catch 36 and repeat the hoisting process.

Figure 6:
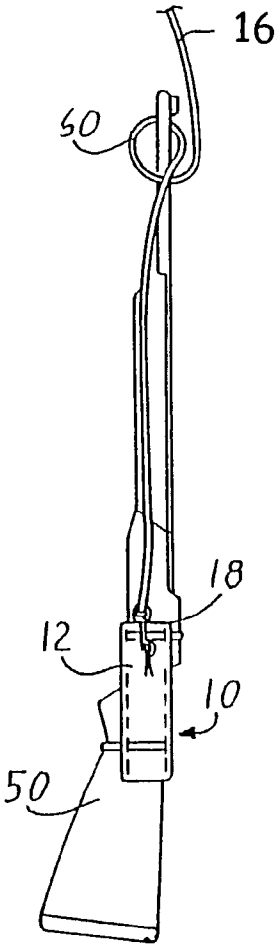
FIG. 6 is a perspective view of the gurney lifting device showing the rifle attached to the gun gurney and with the cord of the lifting device wrapped around the upper end of the rifle barrel, with the barrel pointing upwardly.
Figure 5:
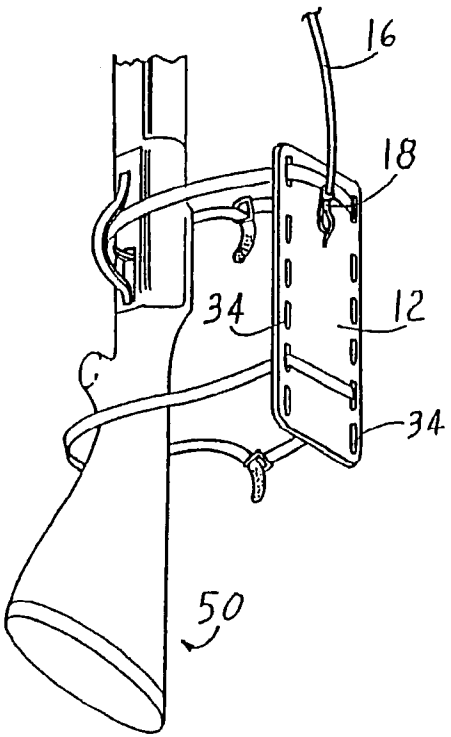
FIG. 5 is a fragmentary perspective view of the gurney lifting device, showing the gurney attached to the rifle, with one strap extending through the trigger housing above the trigger and with the butt end of the rifle facing downwardly.

When the hunter selects to hoist the firearm 50 with the barrel pointing upward as in FIGS. 5 and 6, this is accomplished by placing the smooth side or front surface 22 of the lifting fixture or base member 12 against the firearm 50 with the catch 36 pointing towards the barrel. The hunter should position the base member 12 where the bottom of the gurney is at or near the lowest portion of the firearms stock. Thereafter, one of the Velcro straps 14 extends through the pair of lower slots 34 that best fit the firearm 50 and the other Velcro strap 14 extends through the pair of slots 34 at the top of the hoisting fixture 12. Finally, the Velcro straps 14 are wrapped around the firearm 50. It may be necessary to move the hoisting fixture 12 up or down on the firearm 50 to find the best position for it and the Velcro straps 14 as illustrated in FIG. 5. The hunter thereafter pulls on both the Velcro straps 14 and secures the ends. The firearm 50 is now ready to be moved to the hunting location and the fixture 12 is attached to cord 16 and hook 18 by snapping the hook 18 through the catch 36. When hoisting the firearm 50 with the barrel pointing upward, it is necessary to make a loop 60 in the cord 16 and place the loop 60 over the end of the barrel of the firearm 50 as illustrated in FIG. 6. It is recommended that the hunter place the loop 60 three to five inches down from the end of the barrel. The extra step, placing the loop 60 over the end of the barrel, is necessary to properly balance and insure a straight vertical hoist, when hoisting a firearm 50 with the barrel pointing upwards. The loop 60 will be required when raising or lowering the firearm 50 from the elevated hunting position, with the barrel pointing upward. The hunter can now safely climb to the elevated hunting position. After the hunter has reached the elevated position, the firearm can be hoisted up and removed from the fixture or base member 12. This is done by first removing the loop 60 from around the end of the barrel and then loosening the Velcro straps 14. The process is reversed to lower the firearm 50. The hunter now has both hands free to maximize safety. As in the previous method, the hunter unhooks the cord 16 and hook 18 from the base member 12 and the firearm 50 can be placed in a case without removing the base member 12 from the firearm 50. When returning to the hunting location the next day or at a different time, the hunter simply reattaches the cord 16 and hook or latch 18 to the catch 36 of the base member or lifting fixture 12.

Figure 7:
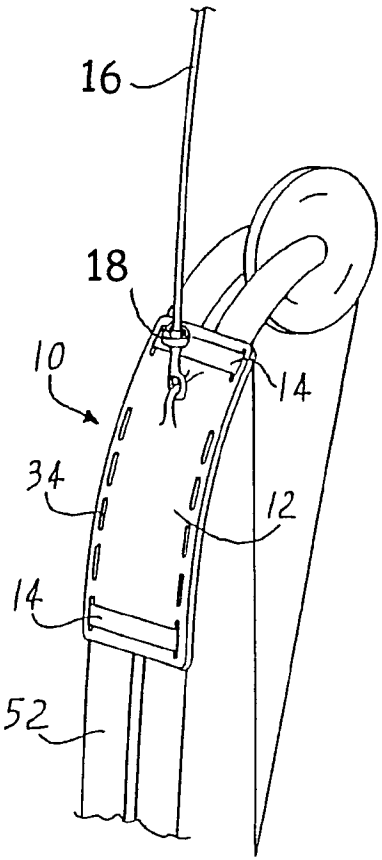
FIG. 7 is a perspective view of the gurney lifting device showing the gurney attached to the archery bow for lifting the gurney and archery bow from the ground to an elevated position.

When an archery bow 52 is to be hoisted to the elevated hunting position, the hunter will adjust the cord 16 and hook 18 to a height where the archery bow 52 can be attached to the lifting fixture or base member 12 but will not allow the archery bow 52 to hit the ground. With the archery bow 52 in a vertical position, as shown in FIG. 7, the hunter places the smooth side or front surface 22 of the base member 12 against the upper portion of the bow limb(s) with the catch 36 pointing upwardly. Using the uppermost and lowermost pairs of slots 34, the hunter wraps the Velcro straps 14 around the archery bow limbs and tightens the Velcro straps 14. The archery bow 52 is now ready to be attached to the cord 16 and hook 18 by connecting the hook 18 to the catch 36 as illustrated in FIG. 7. The hunter can now safely climb to the elevated hunting position. After hoisting the archery bow 52, the hunter needs only to release the Velcro straps 16 and remove the bow 52. The base member can remain attached to the cord 16 and hook 18.

The hunter may, if desired, leave the base member 12 attached to the archery bow 52 after removing the cord 16 and hook 18. When the hunter is ready to lower the archery bow 52 to the ground, either the hunter reattaches the base member to the archery bow 52 or reattaches the cord 16 and hook 18 to the base member if it were left attached to the archery bow 52.

After the archery bow 52 has been lowered, the hunter can climb down from the elevated hunting position with both hands to maximize safety. The hunter can disconnect the cord 16 and hook 18 from the base member or lifting fixture 12. The lifting fixture 12 need not be removed from the archery bow 52. The archery bow 52 will fit into most cases with the base member or lifting fixture 12 attached. When the hunter returns to the hunting area, he or she simply reattaches the cord 16 and hook 18 to the base member or lifting fixture 12 that is still attached to the archer bow 52.

It will be appreciated from the above description that, when the present invention is attached in the described manner, that firearms 50 and archery bows 52 will remain substantially parallel to the longitudinal axis of the hoisting cord 16 while being hoisted. Therefore, it will be understood that under most circumstances, firearms 50 or archery bows 52 will be vertically oriented to the lifting cord 16 while being hoisted from an elevated position as shown in FIG. 1, thus, minimizing the changes of the firearm 50 or archery bow 52 from spinning freely and becoming entangled in tree branches, ladders, foot pegs or other obstructions, while being hoisted.

Thus, there has been illustrated and described a unique and novel gurney or lifting device which permits attachment to a tree limb when the hunter utilizes an elevated tree stand or platform. Thus, the gurney lifting device of the present invention fulfills all of the features and advantages which have been described. It should be understood that many changes, modifications, variations and other uses and applications will become apparent to those skilled in the art after considering this specification and accompanying drawings. Therefore, any and all such changes, modifications, variations and other uses and applications which do not depart from the spirit and scope of the invention are deemed to be covered by the invention.

Accordingly, the scope of the invention should be determined not by the embodiment illustrated, but by the appended claims and their legal equivalents.

What I claim is:

1. A gurney for lifting hunting equipment, to an elevated hunting position, said gurney comprising:

(a) an elongated unitary base member having a pair of parallel longitudinally extending edges, spaced opposite substantially planar front and rear surfaces and spaced opposite first and second end portions;

(b) said base member having inwardly set from each of said longitudinal edges a row of longitudinally spaced elongated slots, the slots in one row being laterally spaced from the slots in the other row;

(c) a raised lifting catch on said rear surface midway between said rows of elongated slots, said catch being located near said first end portion which forms the top of said base member;

(d) a pair of elongated Velcro straps, each having a loop fixed on one end and through which the other end of the strap extends, each strap extending through a pair of laterally aligned slots, with the ends of the straps overlying the front surface of said base member and being wrapped around the hunting equipment on said front surface to retain same firmly in place; and (e) a lifting cord of non-elastic material having a snap hook on one end engageable with said catch whereby when the other end of said cord is attached to a tree limb, elevated platform or tree stand, the loaded gurney may be safely raised by lifting the cord and gurney thereby transporting the gurney and hunting equipment between the ground and tree limb, elevated platform or tree stand.

2. The gurney as recited in claim 1, wherein said elongated unitary base member is made from urethane.

3. The gurney as recited in claim 2, wherein the base member is made utilizing a molding process.

4. The gurney as recited in claim 3, said catch and said slots are made during said molding process.

5. The gurney as recited in claim 1, wherein said catch is integrally formed with such base member and includes a raised portion spaced from said rear surface.

6. The gurney as recited in claim 1, wherein each row of slots has an equal number of slots, with the slots being longitudinally spaced along the length of each row.

7. The gurney as recited in claim 4, wherein said row of slots contain a pair of elongated slots at each of said end portions.

8. The gurney as recited in claim 1, wherein each Velcro strap has a plastic loop at one end and a pointed or curved configuration at the other end to facilitate the insertion of said other end of the strap through said plastic loop.

9. The gurney as recited in claim 1, wherein said lifting cord is constructed from a narrow band of non-elastic material.

10. The gurney as recited in claim 9, wherein the non-elastic material of said lifting cord is flexible.

11. The gurney as recited in claim 1, wherein the hunting equipment is a shotgun or rifle and is attached to the front surface of said base member, with the butt end of the rifle extending upwardly, said Velcro straps being wrapped around the shot gun or rifle, one strap above the trigger housing and one strap below the trigger housing of the shot gun or rifle to thereby prevent the straps from accidentally pulling on the trigger while the gurney and shot gun or rifle are being lifted from the ground to the tree limb, elevated platform or tree stand, with the barrel of the gun pointing downwardly.

12. The gurney as recited in claim 1, wherein said hunting equipment is a shotgun or rifle and is attached to the front surface of said base member, with the butt end thereof facing downwardly and with the barrel pointing upwardly, said Velcro straps being wrapped around the butt end of the shot gun or rifle to retain same against the front surface of said base member while the gurney and shot gun or rifle are being lifted from the ground to the tree limb, elevated platform or tree stand, and with said lifting cord looped around the barrel to maintain the shot gun or rifle vertically erect as it is lifted from the ground.

* * * * *